United States Patent [19]

Miotti

[11] Patent Number: 4,880,334

[45] Date of Patent: Nov. 14, 1989

[54] TUNNEL CONSTRUCTION APPARATUS AND METHOD

[75] Inventor: Giosue Miotti, Lugano, Switzerland

[73] Assignee: Finic, B.V., Rotterdam, Netherlands

[21] Appl. No.: 180,461

[22] Filed: Apr. 11, 1988

[51] Int. Cl.[4] ..... E01G 4/02; E21D 10/04

[52] U.S. Cl. ..... 405/149; 405/132; 405/267; 405/150

[58] Field of Search ..... 405/149, 132, 138, 142, 405/146, 124, 125, 126, 267; 425/59, 63; 249/11, 12

[56] References Cited

U.S. PATENT DOCUMENTS

| | | | |
|---|---|---|---|
| 1,746,566 | 2/1930 | Tufts | 405/149 |
| 1,889,599 | 11/1932 | Goldsborough | 405/266 |
| 2,264,100 | 11/1941 | Smith | 405/151 |
| 3,412,562 | 11/1968 | Doughty | 405/267 |
| 4,073,148 | 2/1978 | Zaretti | 405/149 X |
| 4,601,615 | 7/1986 | Cavalli | 405/267 |

FOREIGN PATENT DOCUMENTS

| | | | |
|---|---|---|---|
| 929363 | 7/1973 | Canada | 405/267 |
| 0197021 | 10/1986 | European Pat. Off. | 405/149 |
| 913527 | 12/1962 | United Kingdom . | |
| 913528 | 12/1962 | United Kingdom . | |

*Primary Examiner*—Dennis L. Taylor
*Attorney, Agent, or Firm*—Jim Zegeer

[57] ABSTRACT

According to the present invention, tunnels, particularly shallow tunnels, are constructed by excavating slurry filled cross-trenches in a direction transverse to the axis of the tunnel and at regular intervals along the line or axis of the tunnel. Prefabricated frame elements are inserted into the cross-trenches to, in essence, create the tunnel wall lateral support structure before the tunnel walls are installed. Then the tunnel sidewalls are excavated under bentonite clay or mud slurry to form cross-slots between the previously installed support frames. Precast concrete sidewalls or panels are inserted between the support frames. The frames and sidewalls have interlocking tongue and groove or keyway structures so as to interfit and lock same into position. When the sidewalls are in place, the roof of the tunnel may be either cast in place and then the soil excavated to form the actual tunnel and then the floor cast or the tunnel may be excavated down to the floor or invert level and then the floor or inverts cast and then the roof cast.

6 Claims, 4 Drawing Sheets

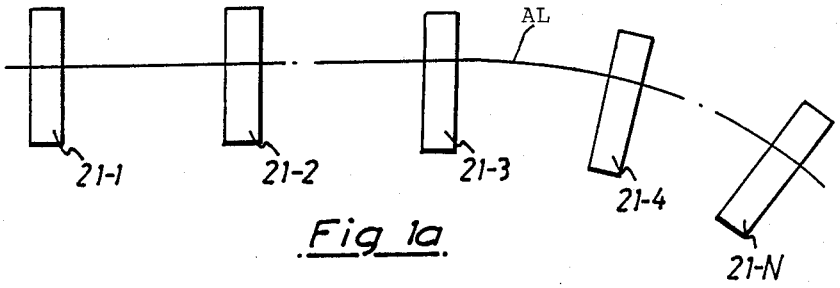
Fig 1a
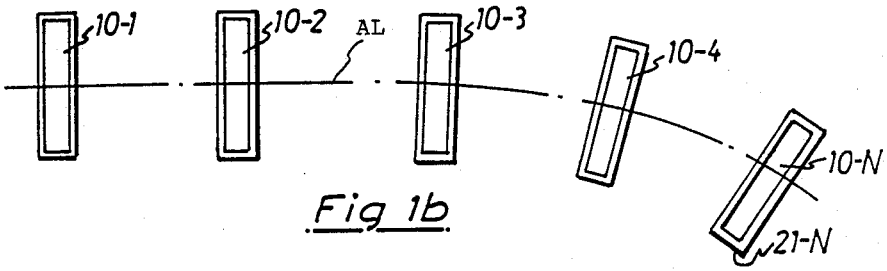
Fig 1b
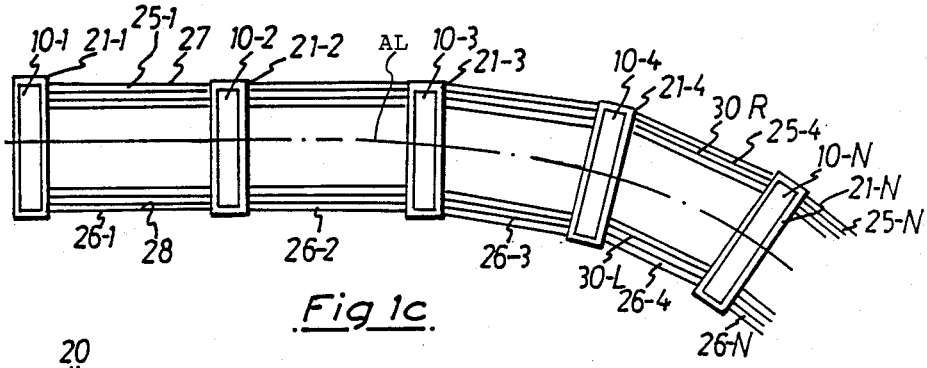
Fig 1c
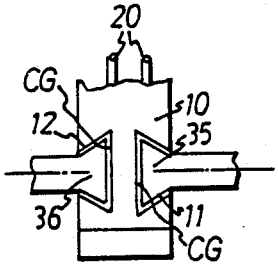
Fig 1c-E-A
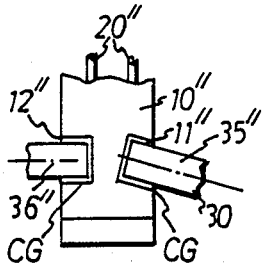
Fig 1c-E-C

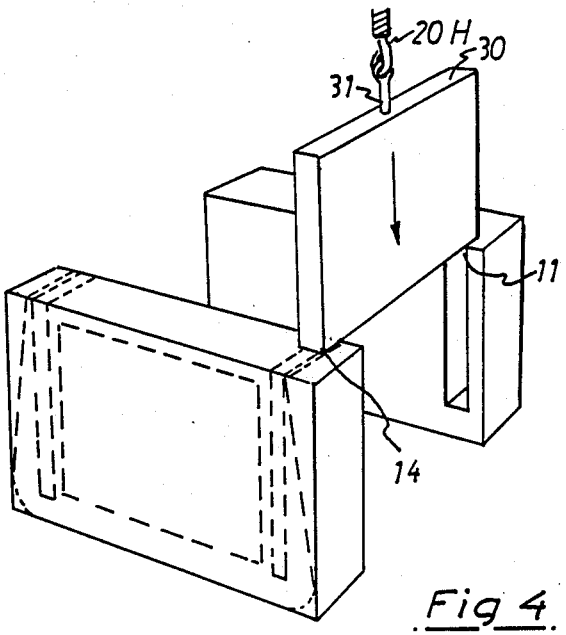
Fig 4
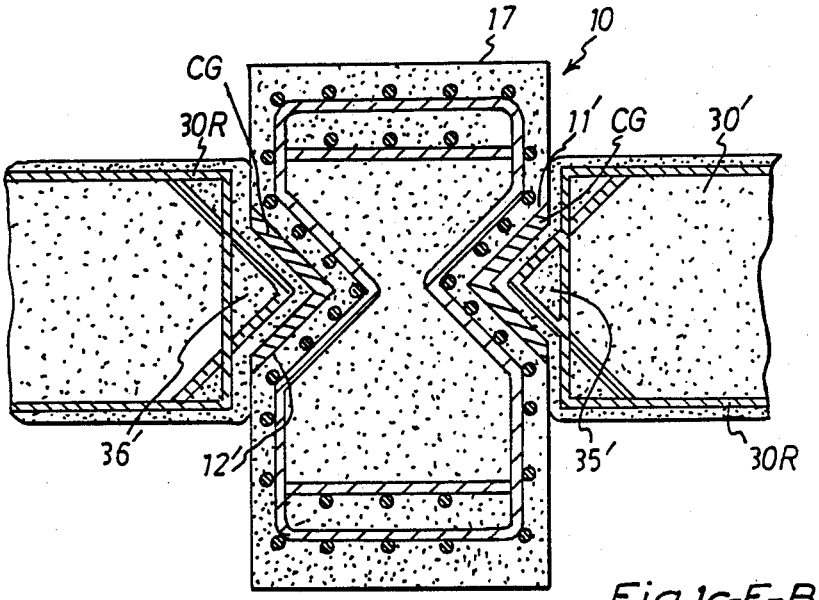
Fig 1c-E-B

TUNNEL CONSTRUCTION APPARATUS AND METHOD

BACKGROUND AND BRIEF DESCRIPTION OF THE INVENTION

In the past, slurry trench techniques, as disclosed in Brunner British Pat. Nos. 913,527 and 913,528 and, Veder U.S. Pat. No. 3,310,952, have been used in the construction of tunnels and, in one example, a pair of slurry trenches forming the sidewalls are formed in panel sections and in which the concrete forming the sidewalls is cast in situ forming two spaced apart sidewalls for the tunnel, the concrete being preferably steel reinforced by steel cages and the like. The tunnel roof may then be cast directly on the unexcavated tunnel and spanning the space between the previously cast concrete walls. Then the tunnel itself is excavated under the cast concrete and the floor or invert is poured. Alternatively, the walls may be precast panels and lowered into the slurry trench excavation with grouting inserted between the earth walls. The wall panels may extend between solidier beams or concrete columns as shown in Miotti U.S. Pat. No. 3,139,729, and interlocked to form the tunnel walls. Thereafter, the roof and floor may be cast as previously described.

According to the present invention, tunnels, particularly shallow tunnels, are constructed by excavating slurry filled cross-trenches in a direction transverse to the axis of the tunnel and at regular intervals along the line or axis of the tunnel. Prefabricated frame elements are inserted into the cross-trenches to, in essence, create the tunnel wall lateral support structure before the tunnel walls are installed. Then the tunnel sidewalls are excavated under bentonite clay or mud slurry to form cross-slots between the previously installed support frames. Then the precast concrete sidewalls or panels are inserted between the support frames. The frames and sidewalls have interlocking tongue end groove or keyway structures so as to interfit and lock same into position. When the sidewalls are in place the roof of the tunnel may be either cast in place and then the soil excavated to form the actual tunnel and then the floor cast or the tunnel may be excavated down to the floor or invert level level and then the floor or inverts cast and then the roof cast.

By following the invention, the tunnel can be constructed faster and less expensively and result in a significantly improved tunnel product. Since the panel sides and the support frames are precast or prefabricated, it makes for greater uniformity, reduction in cost, better surfaces and also reduced sections (resulting in a saving of materials) this is because many times what happens in the slurry wall excavation, and practically speaking, there are not excavating tools less than 2' wide which are commercially available. The precast steel reinforced concrete side panel walls or planks constituting the sidewalls of the tunnel can be 10" or 12" thick and with the excavation tools being approximately 2' wide, the oversize permits the aligning of the panels and the frames perfectly because it allows some play. Moreover, the big oversize allows the grouting to be placed in the space between the outer sidewall of the panels and the frames and the remaining earth wall forming the tunnel resulting in an architecturally much better job. Moreover, it is advantageous to prefabricate and precast the support frames and wall panels since this enables a much better quality control of the structure that is going to be put into the tunnel and they can be positioned perfectly so that the natural roughness of the slurry wall cast in situ is eliminated. The basic concept therefor is the concept of putting in prefabricated concrete to support frames in a slurry trench transversely to the excavation or tunnel direction and in essence creating a support structure before the tunnel side (as well as roof and floors) walls are installed.

Thus, the object of the invention is to provide an improved method of constructing underground tunnels, particularly shallow tunnels.

BRIEF DESCRIPTION OF THE DRAWINGS:

The above and other objects, advantages and features of the invention will become more apparent when considered in conjunction with the accompanying drawings wherein:

FIG. 1*a* is a top plan view illustrating the excavation of a series of transverse frame receiving slots along the longitudinal axis of the tunnel, FIG. 1*b* is a top plan view similar to FIG. 1*a* showing the insertion therein of the transverse lateral support frame members, FIG. 1*c* is a top plan view of the tunnel showing the excavation slots for the side panels and the insertion therein in some of them of the prefabricated side panels, FIGS. 1*c-e-a* is an enlarged sectional view of the circled portion of shown in FIG. 1*c* showing keyway connections between the slots or grooves in the lateral support frame members and the side panels, FIG. 1*c-e-b* shows a preferred alternative keyway construction, FIG. 1*c-e-c* shows a further preferred construction for curves and the like, FIG. 2 is an isometric perspective view showing the transverse slots being constructed in the earth, FIG. 4 is a cross-sectional view showing the side panels in place.

DETAILED DESCRIPTION OF THE INVENTION

The method and apparatus to be described involves construction of underground tunnels, particularly shallow tunnels, that is, one that is not too far below the surface or below grade, along a given tunnel path or axis.

Figure 2:
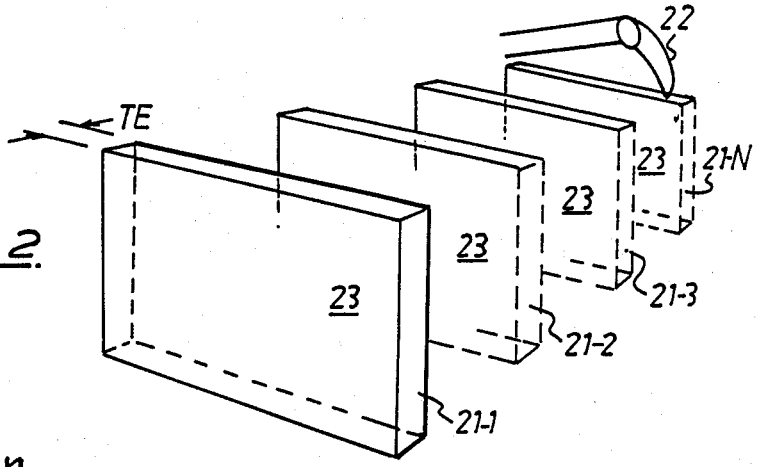
Figure 3:
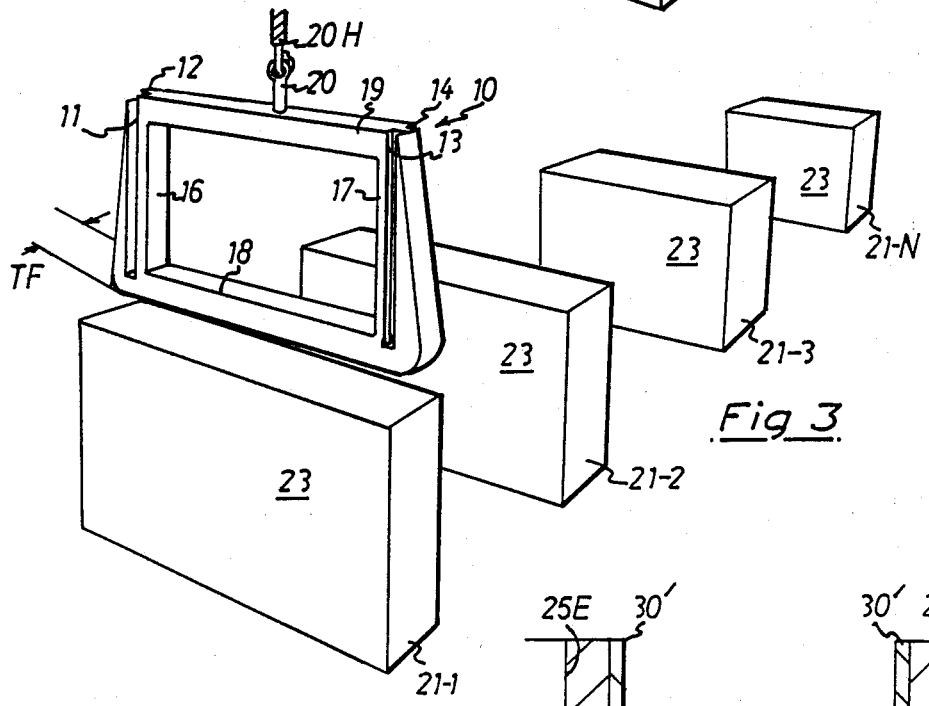
FIG. 3 is an isometric perspective view showing one of the lateral support frames being lowered into the slurry filled transverse slots or trenches.

Initially, transverse frame elements 10 (FIG. 3) are precast above ground with keyways 11, 12, 13 and 14 in the lateral brace columns 16, 17 which are integrally formed with a base member 18 and, preferably, an upper transverse beam member 19. Reinforcing steel 20 provides high tensile and shear strength. In the case of a U-shaped frame element, the upper cross brace member 19 may be omitted and the lower portion of the frame will be shaped such that it is heavier at the bottom so that the vertical legs 16 and 17 will taper from their respective bottoms toward the top and be heavily reinforced at the bottom because of the heavier forces or loading at the bottom. The prefabricated and precast frames 10 have a thickness $T_F$ and are provided with lifting eyes or hooks 20 so that they may be lowered by cable hook 20H from a crane into slurry filled slots 21 which are excavated transverse to the line or axis $A_L$ of the tunnel and have a thickness $T_E$ which is greater than the thickness $T_F$ of the frame elements 10. As shown in FIG. 2, these transverse or cross trenches 21, 21-2, 21-3, . . . 21-N are excavated by a conventional slot excavator or clam shell element 22 while the trenches are maintained full of an excavating slurry such as bentonite mud or clay 23. Typical slurry trench techniques are disclosed in the above referenced Brunner, Miotti and Veder patents. Insertion of precast steel reinforced flat panel elements such as wall panels to form underground wall structures is well known and hence need not be described in greater detail.

After the first pair of frame members 10 have been inserted in the slurry filled excavation slots 21-1 21-2 . . . 21-N, spaced pairs of cross-slots 25, 26 are excavated, again under the presence of a excavation slurry 27, 28, between the facing lateral edges of the steel reinforced vertical column portions 16 and 17, frame elements 10-1, 10-2, 10-3, 10-4 . . . 10-N and a precast sidewall panel 30 is lowered into position with its keyway or tongue and groove coupling ends 35, 36 in interengagement with the groove or slot 11 in one frame element and the opposite end in interengagement with the groove or slot 14 in the next adjacent frame element 10. The wall panels 30 have lifting means such as a lifting eye or hook 31 received by crane hook 20H. Since the slurry filled slots 21-1, 21-2, 21-3, 21-4 . . . 21-N are slightly larger ($T_E$–$T_F$) than the frame elements 10, the frame elements can be adjusted slightly in position and orientation so as to be precisely positioned and accommodate and receive the individual panel elements. Likewise, the width dimensions of the slurry-filled slots 25-1, 26-1 . . . 25-N, 26-N, is greater than the thickness of side panels or planks 30, the space between the outer surfaces of panels 30 and the earthen walls 25E and 26E is filled with a cementitious grout CG.

The lateral ends of each of the wall panels are keyed into the slots or grooves 11–12; 13–14 formed in the respective steel reinforced vertical columns 16 and 17 of the frame members 10. As shown in FIG. 1*c-e-a*, the ends of the panel 30 may have a slight flare 35, 36 or enlargement to interengage with complementary shaped slots 11 and 12, respectively. In this case, the slots 11 and 12 are large enough relative to the enlarged panel ends 35 and 36 to allow adjustment of their positions. Any space is filled with a cement grout CG. In FIG. 1*c-e-b*, the V-shaped slots 11′, 12′ respectively, with a complimentarily shaped end rib 35′ and 36′, respectively. In FIG. 1*c-e-c*, the slots 11″ and 12″ are rectangularly shaped. Slot 11″ may be at a slight angle so as to accommodate curves on the like portions of the tunnel. In the cases of curves and the like, the opposing sidewall panels 30 would not be of the same length, as shown in FIG. 1*c* for panels 30-L and 30-R.

Figure 5:
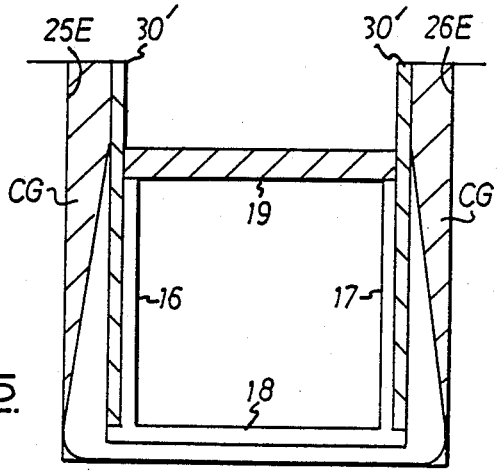
FIG. 5 is a sectional view of a modification of the invention.

As shown in FIG. 5, the panels or planking 30′ may extend above the roof of the tunnel to act as retaining walls for the shallow excavation needed to pour the roof of the tunnel. In some cases this may be 8 to 10 feet.

Figure 6:
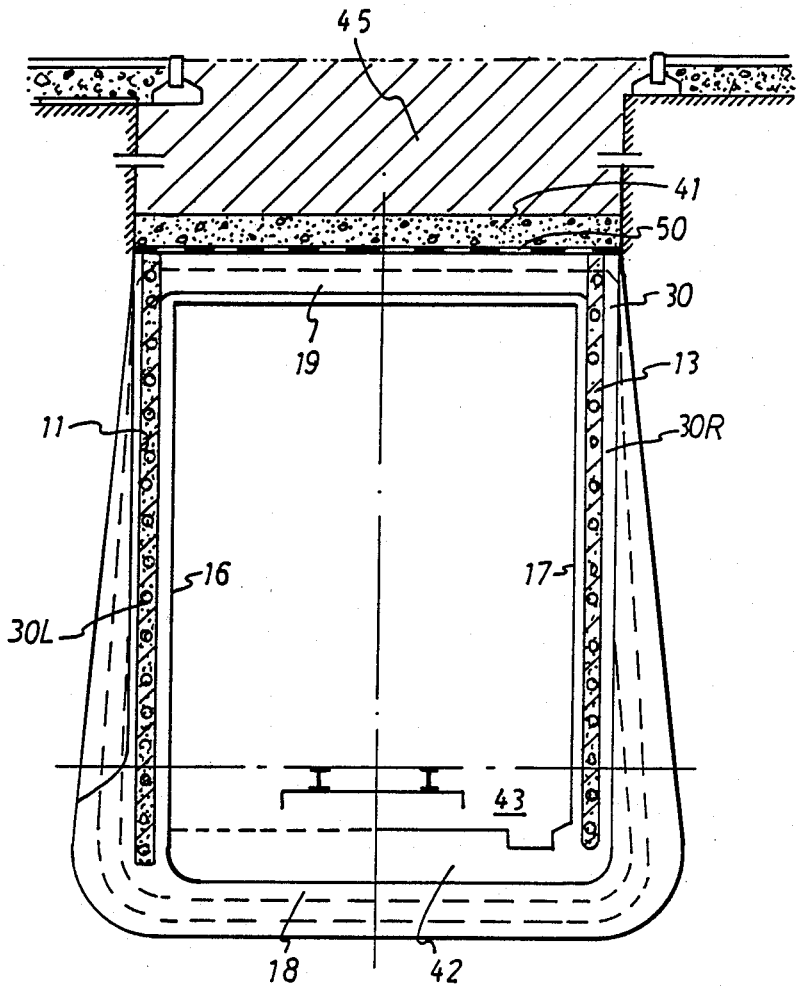
FIG. 6 is a cross-sectional view of the constructed tunnel showing one of the frame members and the location of rail lines, for example.

FIG. 6 illustrates a partial sectional view of a rail tunnel incorporating the invention. In this case the tunnel is located under the median of a highway. A steel roof support form 50 carries the conventional concrete roof 41. A conventional invert or concrete floor structure 42 and rail line and bed 43 are installed as illustrated. The floor or invert 42 and the roof 50 may be poured after the walls 30 have been installed. If it is desired to reconstitute the surface quickly, the procedure is to excavate just to the bottom of the roof, pour the roof 41, backfill (the earth 45) and then go under and excavate the contained earth and just pour the invert or floor 43 as the internal excavation of confined soil proceeds.

While steel reinforced precast concrete frames 10 are preferred in a broader sense, the invention can be carried out wherein the support frames 10 are all steel beams and channels.

By installing the tunnel precast support frames 10 first, all cross-locked bracing that is normally done as the excavation proceeds is dispensed with. Once these have been placed and the precast wall panels positioned in place, the structure is stable and the earth walls already supported. Moreover, the bentonite slurry has penetrated the earthen walls and stabilized same as is now well known in the art. Thus, in essence at this point, there is no concern with bracing as the excavation proceeds because the tunnel excavation proceeds within stabilized form e.g. the support frames 10 and keyed-in wall panels 30, and the only thing to remove is the dirt, whichever way of dirt removal as is most convenient. Thus, tunnel construction using the present invention is faster and more economical. Since the support frames and wall panels are precast, they have greater uniformity and their quality can be very closely controlled. The tunnel surfaces are better formed (smoother) and require less finishing. Also, the cross-sections, and hence materials used, are reduced. In slurry wall excavations, most excavating rigs are, practically speaking, not less than about 2 feet. Sometimes they are designed to be less, but as a practical matter clam shells, kelly rigs, etc. for this type excavation have the 2 foot limitation. However, the tunnel walls do not need to be that thick, the oversize of the slot excavation is advantageous in that it allows some play so they may be aligned perfectly. The grouting e.g. between the outer panel surfaces and earth walls firms the panels in place and results in an architecturally better job.

While the preferred embodiments of the invention have been described, it is to be understood that the disclosure is for the purpose of illustration and to enable those skilled in the art to practice the invention, and it is intended that other embodiments and modifications of the invention can be made without departing from the spirit and scope of the invention as set forth in the appended claims.

What is claimed is:

1. A method of constructing a underground tunnel along a given path, precasting in molds above ground at least a pair of frame elements, each frame element comprising a cross brace and a pair of vertical side column members, sidewall keyway means formed in said vertical side column members, precasting in molds above ground at least a pair of wall panel elements having lateral ends for adapted to enter said keyway means in respective ones of said vertical side column of said elements, excavating, under the presence of a slurry, at least a pair of slots in the earth, said at least a pair of slots extending laterally transverse to the longitudinal direction of said tunnel along said given path, inserting one each of said frame elements into each said rectangular slots in the earth, excavating a pair of sidewall slots between the lateral ends of said pair of rectangular laterally extending slots, inserting one each of said wall panels in said side slots and with the respective lateral ends in keyway engagement with said keyway means formed in said elements, and forming a concrete floor and roof for said tunnel between said wall elements and said frame elements.

2. Prefabricated tunnel and method of construction, said tunnel having a longitudinal axis:

I. excavating a series of elongated slurry filled trench slots transverse to said longitudinal axis, II. inserting a prefabricated steel reinforced concrete frame member in each of said slurry filled trench slots, III. excavating a series of elongated slurry filled tunnel wall slots between said prefabricated concrete frame members, there being parallel spaced tunnel wall slots excavated between each pair of said prefabricated steel reinforced concrete frame members, IV. inserting a prefabricated wall panel element in each of said tunnel wall slots, and stabilizing said wall panels by injecting a cement grout between said wall panels surfaces and the outside earth surface, and V. forming a concrete floor and roof for said tunnel between said walls and said frame members.

3. An underground tunnel constructed according to the method defined in claim 1.

4. An underground tunnel constructed according to the method defined in claim 2.

5. A steel reinforced precast concrete level wall support frame element for constructing an underground tunnel comprising, a "U" shaped steel reinforced concrete element having a pair of vertically upright column members having an upper end and a base, and an integral steel reinforced concrete base member joining the bases of said pair of vertically upright column members, and each said vertically upright column member having keyway elements on oppositely facing concrete surfaces thereof and opening in the direction of said tunnel.

6. The invention defined in claim 5 including a steel reinforced cross member integrally molded with said "U" shaped frame and extending between the upper ends of said "U" shaped frame member, and lifting means extending from said steel reinforced cross member.

* * * * *